US010576007B1

(12) United States Patent
Barcohana

(10) Patent No.: US 10,576,007 B1
(45) Date of Patent: Mar. 3, 2020

(54) BACK TRACTION DEVICE

(71) Applicant: Babak Barcohana, Van Nuys, CA (US)

(72) Inventor: Babak Barcohana, Van Nuys, CA (US)

( * ) Notice: Subject to any disclaimer, the term of this patent is extended or adjusted under 35 U.S.C. 154(b) by 17 days.

(21) Appl. No.: 15/904,392

(22) Filed: Feb. 25, 2018

(51) Int. Cl.
*A61H 1/00* (2006.01)
*A61H 1/02* (2006.01)

(52) U.S. Cl.
CPC ..... *A61H 1/005* (2013.01); *A61H 1/0222* (2013.01); *A61H 2201/0157* (2013.01); *A61H 2201/1623* (2013.01); *A61H 2203/0406* (2013.01); *A61H 2203/0493* (2013.01); *A61H 2205/088* (2013.01)

(58) Field of Classification Search
CPC ..... A61H 1/005; A61H 1/0222; A61H 2203/0493; A61H 2203/0406; A61H 2201/1623; A61H 2201/0157; A61H 2205/088
USPC ..... 482/142
See application file for complete search history.

(56) References Cited

U.S. PATENT DOCUMENTS 3,491,385 A * 1/1970 Werner ..... A61G 13/00 5/633
3,759,511 A * 9/1973 Zinkin ..... A63B 21/015 482/51
4,566,693 A 1/1986 Seidentop
4,606,332 A * 8/1986 Gibson ..... A61G 13/009 606/241
4,611,806 A * 9/1986 Terry ..... A63B 23/0233 482/142
4,753,438 A * 6/1988 Paris ..... A61H 1/0218 482/144
4,867,142 A * 9/1989 Jones ..... A61H 1/0229 601/115
5,066,003 A * 11/1991 Jones ..... A63B 21/0615 482/137
5,100,131 A 3/1992 Fong
5,163,890 A * 11/1992 Perry, Jr. ..... A63B 21/00047 482/142
5,217,487 A 6/1993 Engel et al.
5,913,758 A * 6/1999 Nunez ..... A61H 1/0292 482/140
6,443,879 B1 * 9/2002 Chen ..... A61H 1/0218 482/143
7,563,215 B1 7/2009 Ross, Jr.
7,691,041 B2 * 4/2010 Abdo ..... A63B 21/4047 482/142
7,699,763 B2 4/2010 Perry, Jr.
7,704,200 B2 * 4/2010 Rahimi ..... A61H 1/0229 482/142
7,942,795 B2 5/2011 Harris
8,491,450 B2 7/2013 Perry, Jr.
(Continued)

*Primary Examiner* — Andrew S Lo
(74) *Attorney, Agent, or Firm* — Thomas I. Rozsa

(57) ABSTRACT

A back traction apparatus which serves two primary functions. First, the present invention enables a user to stretch their back by lying on the pillow of the present invention which is configured in a unique shape and design. By being able to lie on the pillow, a user does not have to use an inversion table which could be both dangerous and require supervision. In addition, the present invention oscillation enables a user to correct slight misalignment of the user's hips and to more comfortably have the user's hips rotated so that the hips are rotated into an appropriate alignment.

20 Claims, 13 Drawing Sheets

(56) References Cited

U.S. PATENT DOCUMENTS

| | | | | |
|---|---|---|---|---|
| 8,529,413 | B2 * | 9/2013 | Simmons | A63B 21/0615 482/100 |
| 9,669,255 | B2 * | 6/2017 | Henniger | A63B 23/0222 |
| 2003/0216781 | A1 * | 11/2003 | Cuccia | A61G 13/009 606/237 |
| 2005/0181917 | A1 * | 8/2005 | Dayal | A61H 1/0222 482/142 |
| 2005/0242639 | A1 * | 11/2005 | Ha | A61H 1/006 297/230.1 |
| 2008/0096744 | A1 * | 4/2008 | Perry, Jr. | A61H 1/0218 482/144 |
| 2010/0198120 | A1 * | 8/2010 | Tago | A61H 1/0237 601/134 |
| 2013/0079690 | A1 * | 3/2013 | Chen | A61H 1/005 601/134 |
| 2013/0226051 | A1 * | 8/2013 | Lu | A61H 7/007 601/99 |
| 2013/0253582 | A1 * | 9/2013 | Tielve | A61H 1/0292 606/240 |
| 2014/0378283 | A1 * | 12/2014 | Qiu | A63B 26/00 482/142 |
| 2015/0313784 | A1 * | 11/2015 | Evans | A61H 1/0229 602/36 |
| 2016/0243395 | A1 * | 8/2016 | Ban | A61H 1/0292 |
| 2016/0331622 | A1 * | 11/2016 | Haene | A61H 1/0222 |

* cited by examiner

BACK TRACTION DEVICE

BACKGROUND OF THE INVENTION

1. Field of the Invention

The field of the invention relates to apparatus which are used for back stretching and posture improvement.

2. Description of the Prior Art

The following seven (7) patents and published patent applications are the closest prior art known to the inventor.

1. U.S. Pat. No. 4,566,693 issued to Alfred T. Seidentop et al. on Jan. 28, 1986 for "Gravity Traction Apparatus";
2. U.S. Pat. No. 5,100,131 issued to Walter Fong on Mar. 31, 1992 for "Back Muscle Exercising and Stretching Apparatus";
3. U.S. Pat. No. 5,217,487 issued to Timoth S. Engel et al. on Jun. 8, 1993 for "Back Therapy System";
4. U.S. Pat. No. 7,563,215 issued to Raymond Ross, Jr. on Jul. 21, 2009 for "Abdominal Muscle Standing Exerciser";
5. U.S. Pat. No. 7,699,763 issued to Leroy R. Perry, Jr. on Apr. 20, 2010 for "Abductor Contraction, Variable Leg/Knee/Thigh/Trunk and Spinal Decompression Exercise and Rehabilitation Apparatus and Method";
6. U.S. Pat. No. 7,942,795 issued to Robert W. Harris on May 17, 2011 for "Stretching and Toning Device";
7. U.S. Pat. No. 8,491,450 issued to Leroy R. Perry, Jr. on Jul. 23, 2013 for "Rotary, Adjustable Body Exercise Equipment".

None of the prior art known to the inventor disclose the unique features of the present invention as disclosed hereinafter.

SUMMARY OF THE INVENTION

The present invention is a back traction apparatus which serves two primary functions. First, the present invention enables a user to stretch their back by lying on the pillow of the present invention which is configured in a unique shape and design. By being able to lie on the pillow, a user does not have to use an inversion table which could be both dangerous and require supervision. In addition, the present invention oscillation enables a user to correct slight misalignment of the spine and to more comfortably have the user's hips rotated so that the hips are rotated into an appropriate alignment. No medical claim is made on this apparatus. It is simply an apparatus to enable a user to stretch their back and also to slightly rotate the user's hips if they are slightly out of alignment without requiring medical aid.

It is also an object of the present invention to decrease back pain by the stretching of the spine through use of the present invention.

It is an additional object of the present invention to provide an elevated top cushion support that is mounted on a base. The elevated top cushion support has a front cushion and a top cushion.

It is a further object of the present invention to provide a front cushion that rotates and stretches a user's back when a user rests their torso against the present invention back stretcher.

It is still a further object of the present invention to provide a front cushion that has a range of rotation of approximately 20 degrees in each direction and a speed that can increase how fast the front cushion oscillates from a slower speed to a faster speed to rotate the spine into alignment.

It is still a further object of the present invention to provide a user with alternative positions that permit the user to stretch their back by either lying over the front cushion of the present invention back stretcher or lying over the top cushion of the present invention back stretcher.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Figure 1:
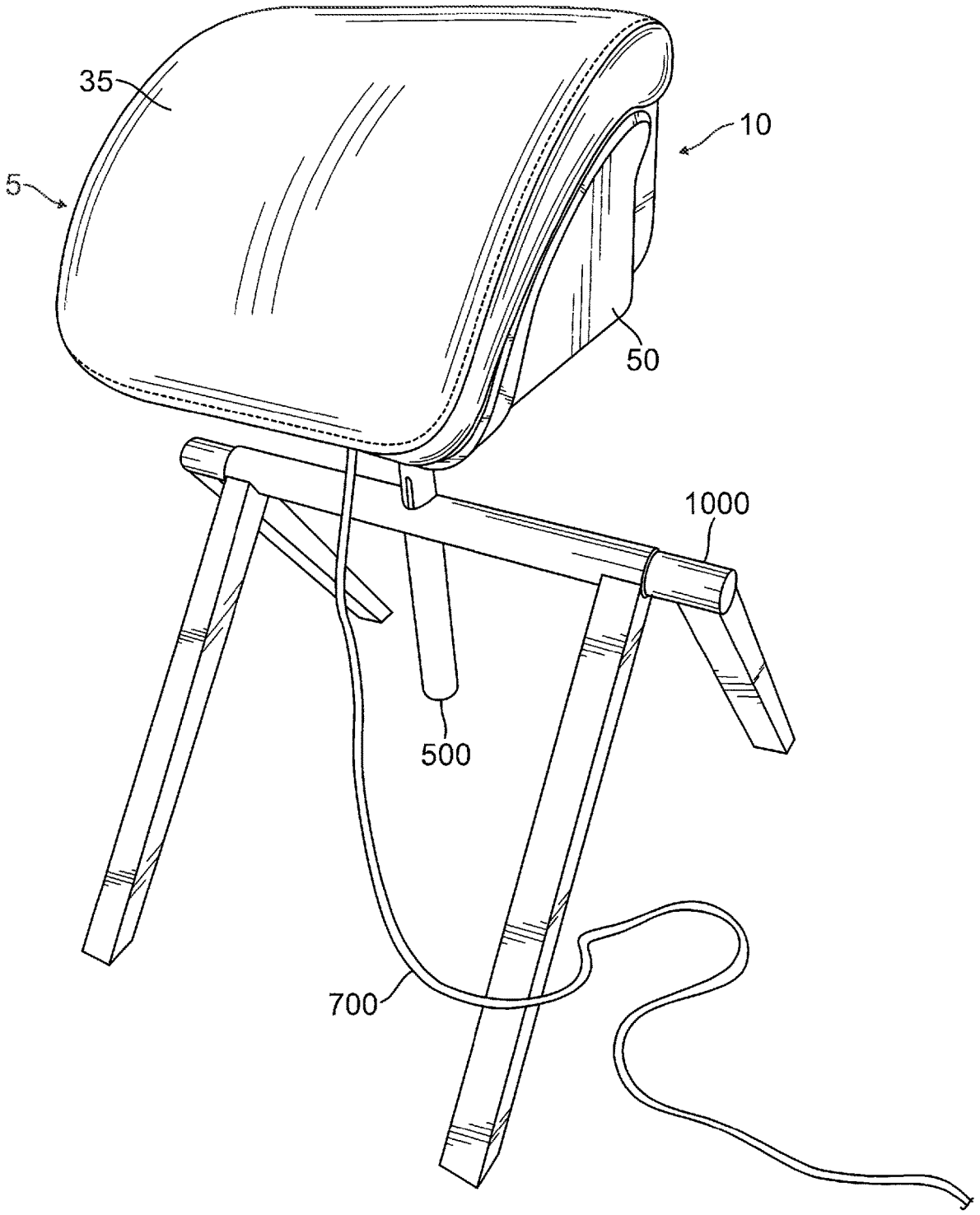
FIG. 1 is a rear perspective view of the present invention back stretcher with the base attached.
Figure 2:
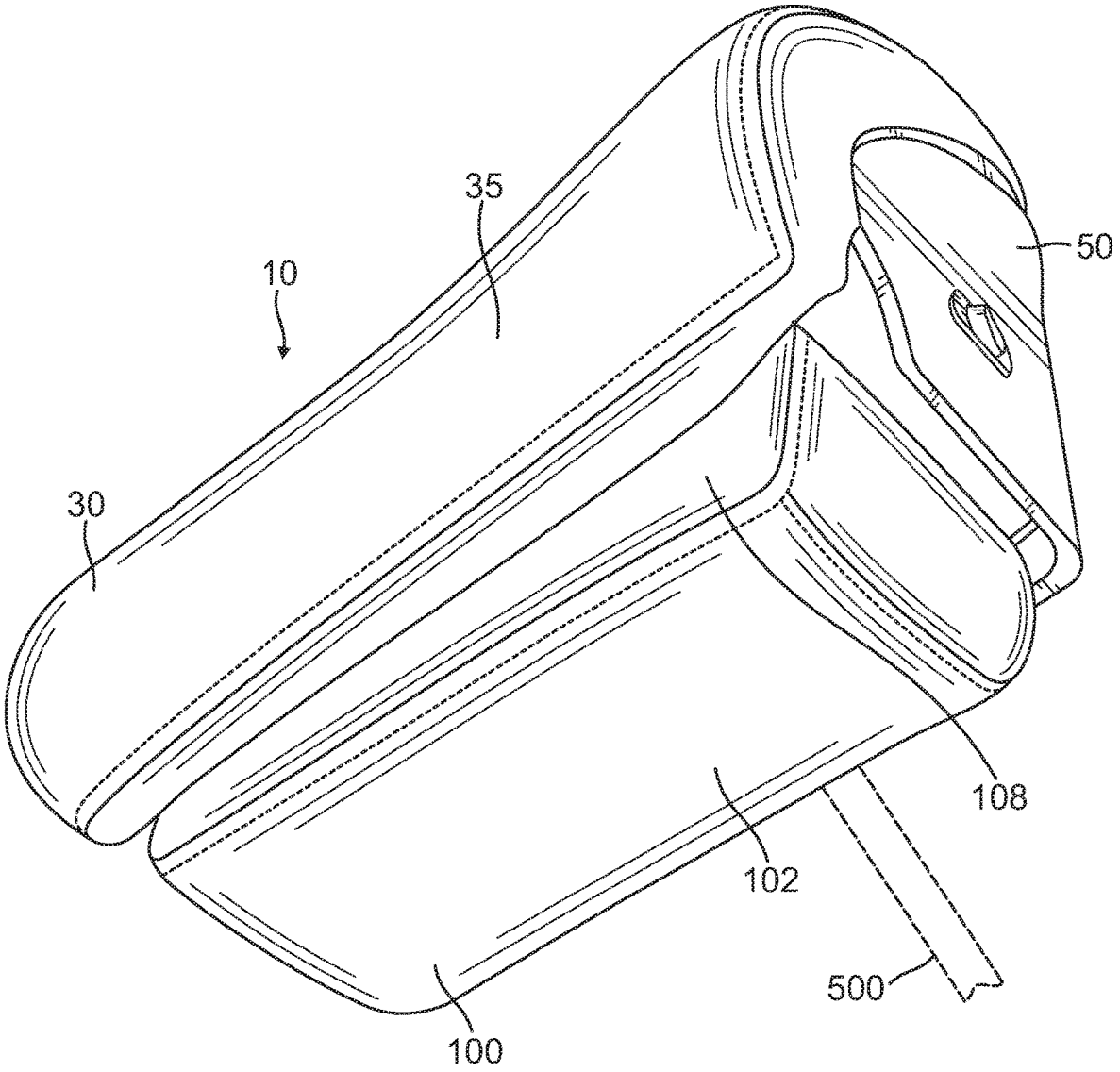
FIG. 2 is a top right perspective view of the cushion platform portion of the present invention back stretcher with the base removed.
Figure 3:
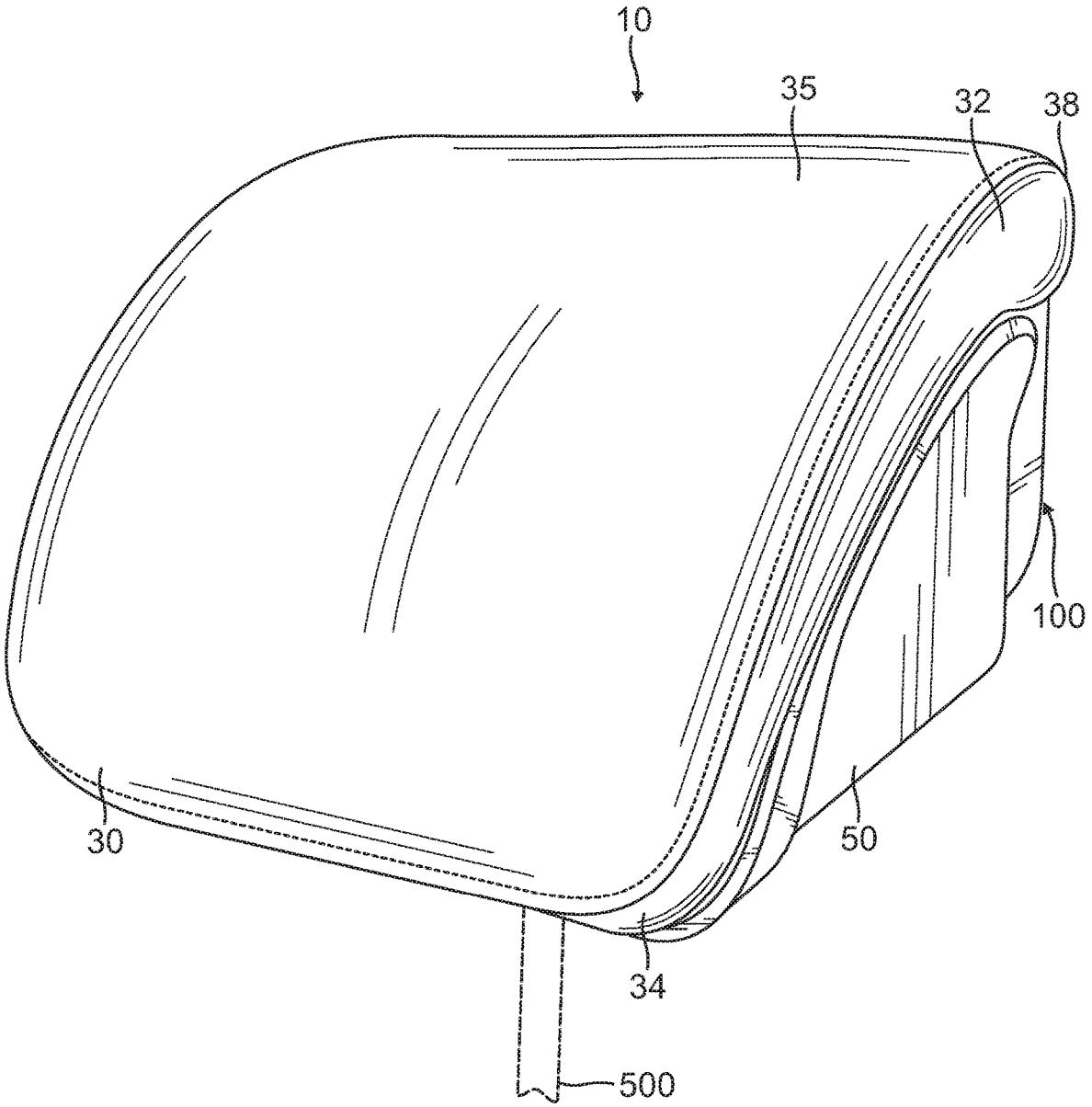
FIG. 3 is a rear perspective view of the cushion platform portion of the present invention back stretcher with the base removed.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1, 2, 3, 4, 8, 9 and 14, there is illustrated the present invention back stretcher 5, having a cushion platform 10, a base 1000, power cord 700, and a connection post 500. The cushion platform 10 has a top cushion support structure 50 and a front cushion support structure 110. Front cushion support structure 110 retains a front cushion 100 having a front cushion front surface 102 and a front cushion top surface 108. Top cushion support structure 50 retains top cushion 30 having a top cushion top surface 35, a top cushion front surface 38, a top cushion rear surface 34, and a top cushion left surface 32.

Figure 4:
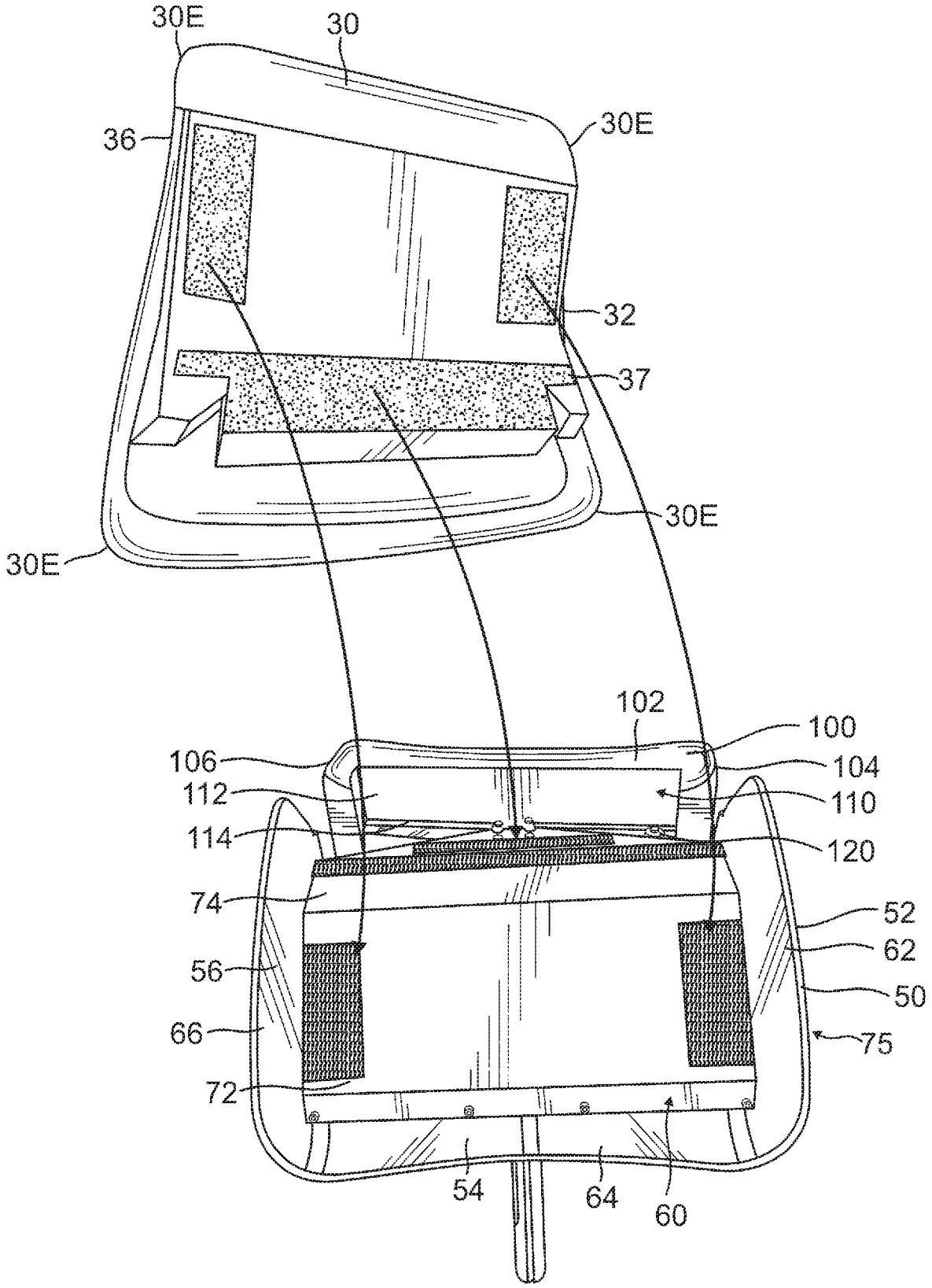
FIG. 4 is an exploded view of the cushion platform portion of the present invention back stretcher with the top cushion removed from the cushion platform.

Referring to FIG. 4, there is illustrated an exploded view of top cushion support structure 50 with top cushion 30 removed and front cushion 100 attached and in an oscillating position. Top cushion support structure 50 has a left vertical wall 52, a back vertical wall 54, a right vertical wall 56, a left upper curved wall section 62, a back upper curved wall section 64, a right upper curved wall section 66, a platform interior chamber 60, and a top shelf 75. Top shelf 75 is formed from the horizontal surface created from the direct connection of left upper curved wall section 62, back upper curved wall section 64, and right upper curved wall section 66. Platform interior chamber 60 which is contained between left vertical wall 52, back vertical wall 54, and right vertical wall 56 is sized to receive top cushion 30 as shown in the FIG. 4 exploded view.

Further referring to FIG. 4, platform interior chamber 60 also contains platform vertical base plate 72 and a platform horizontal base plate 74. When top cushion 30 is placed into platform interior chamber 60, platform vertical base plate 72 and a platform horizontal base plate 74 primarily support top cushion 30. Top cushion 30 is also supported near top cushion edges 30E by top shelf 75. Top cushion 30 is removably affixed to platform vertical base plate 72 and platform horizontal base plate 74 by hook and loop fasteners that are affixed to top cushion bottom surface 37, platform vertical base plate 72, and platform horizontal base plate 74. It is within the spirit and scope of this invention to have either the hooks or fasteners affixed to either top cushion bottom surface 37 or platform vertical base plate 72 and platform horizontal base plate 74. It is also within the spirit and scope of this invention to have top cushion 30 affixed to platform vertical base plate 72 and platform horizontal base plate 74 by other commonly known affixing means including, but not limited to, tongue and groove fitting, press or snap fitting, and tape or adhesive.

FIG. 4 also illustrates front cushion support structure 110 having a front vertical plate 112 and a centrally located horizontal plate 114. Front cushion vertical plate 110 is generally rectangular shaped and corresponds to the shape and size of front cushion 100. Front cushion support structure 110 also has a pivot arm 120 that connects front cushion support structure 110 to motor 400 (illustrated in FIG. 14) located underneath platform vertical base plate 72. Pivot arm 120 is affixed to at least one side of front cushion support structure 110 at a first end and to a rotational plate 125 of motor 400 at a second end (illustrated in FIG. 14). In the preferred operating mode, the pivot arm 120 causes front cushion support structure 110 to oscillate or rotate in both a clockwise direction and a counterclockwise direction. Alternatively, the operation can be set so that it rotates only in the counterclockwise direction or only in the clockwise direction. The movement of front cushion support structure 110 and front cushion 100 is explained in more detail below.

Figure 5A:
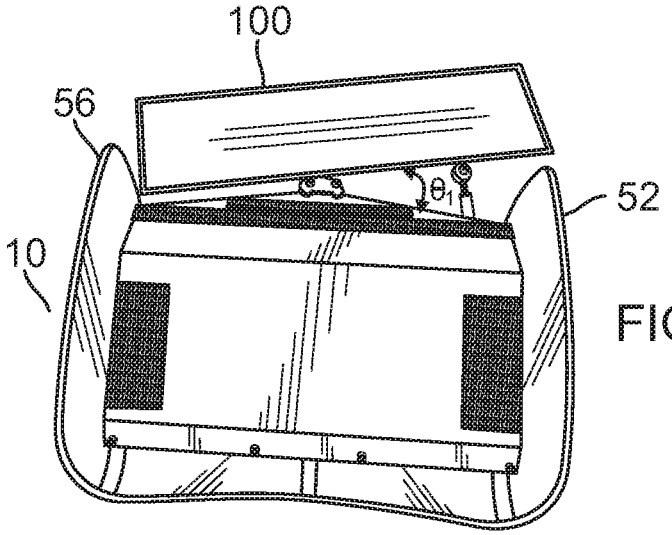
FIG. 5A is a schematic top view of the cushion platform with the top cushion removed and illustrating the front cushion when the front cushion is rotated to its furthest possible angle away from center in the counterclockwise direction towards the right vertical wall of the cushion platform.
Figure 5B:
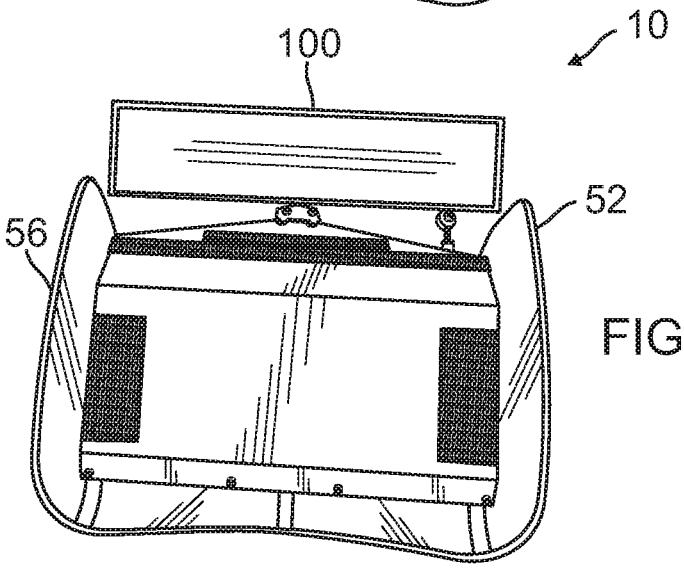
FIG. 5B is a schematic top view of the cushion platform with the top cushion removed and illustrating the front cushion when the front cushion is in a central location between the right vertical wall and the left vertical wall of the cushion platform.
Figure 5C:
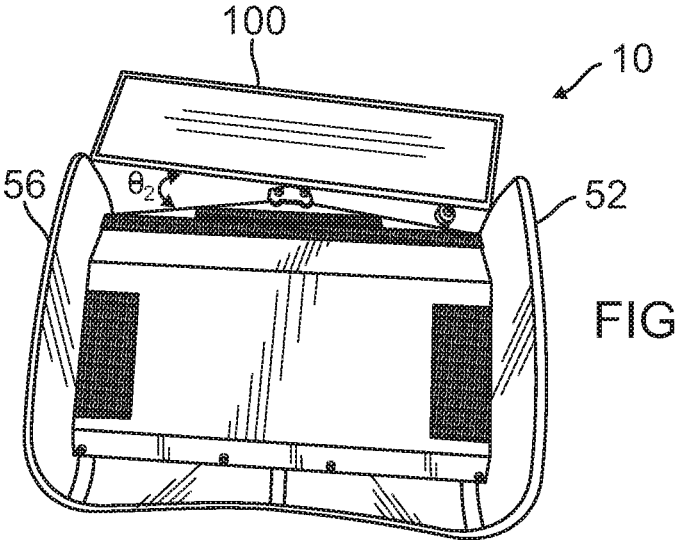
FIG. 5C is a schematic top view of the cushion platform with the top cushion removed and illustrating the front cushion when the front cushion is rotated to its furthest possible angle away from center in the clockwise direction towards the left vertical wall of the cushion platform.

Referring to FIGS. 5A, 5B, and 5C, there is illustrated schematic top views of cushion platform 10 with the top cushion 30 removed. FIG. 5A illustrates front cushion 100 when front cushion 100 is rotated to its furthest possible angle away from center (illustrated in FIG. 5B) and in the counterclockwise direction towards right vertical wall 56. The maximum angle of rotation $\theta_1$ in the counterclockwise and maximum angle of rotation $\theta_2$ in the clockwise direction is approximately 20 degrees. Similarly referring to FIG. 5C, FIG. 5C illustrates front cushion 100 when front cushion 100 is rotated to its furthest possible angle away from the center (illustrated in FIG. 5B) and in the clockwise direction towards left vertical wall 52. During operation, front cushion 100 oscillates continuously between the position illustrated in FIGS. 5A, 5B, and 5C for aligning a user's hips such as user 2000 illustrated in FIG. 13.

Figure 6:
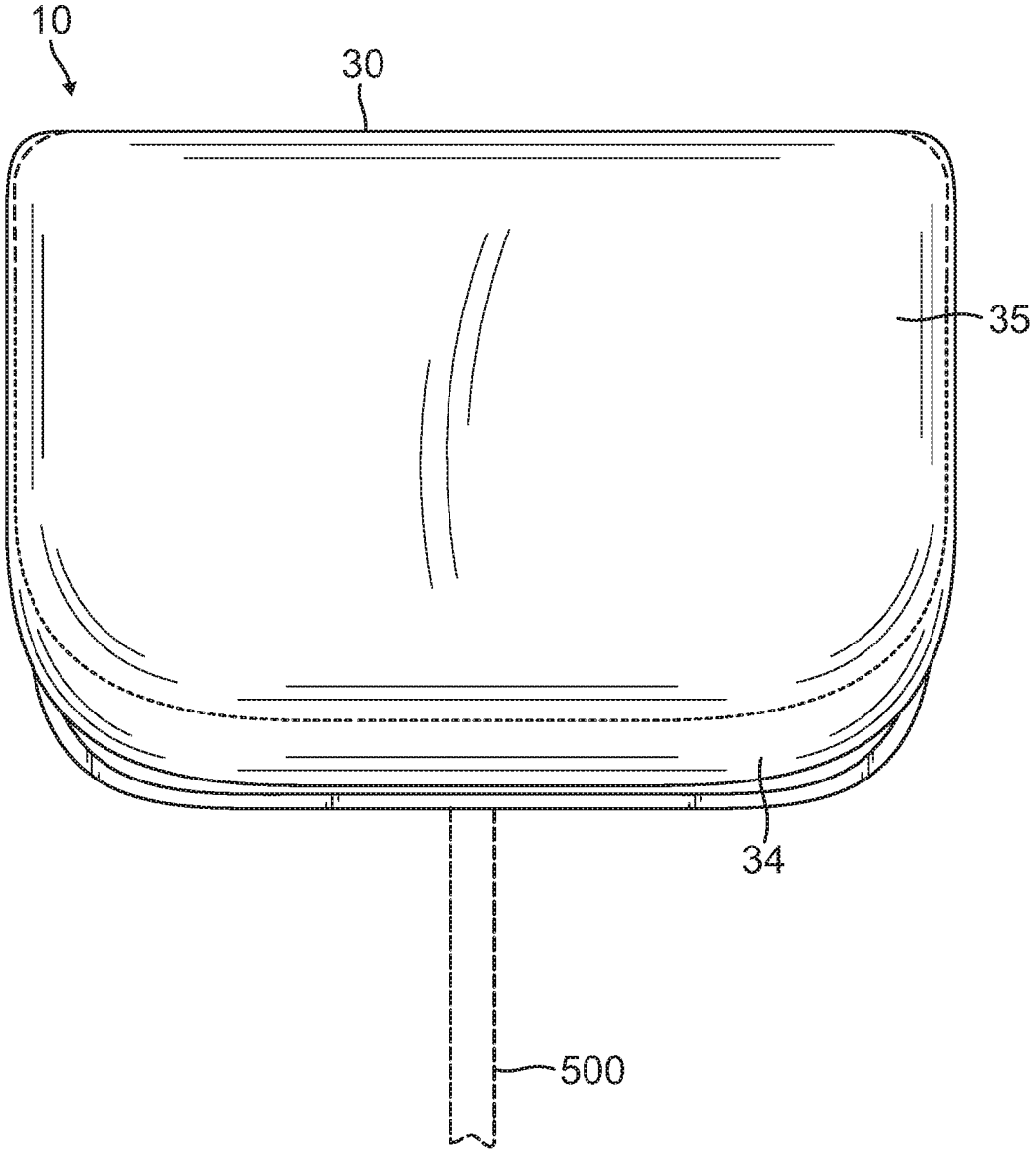
FIG. 6 is a rear view of the cushion platform portion of the present invention back stretcher with the base removed.

Referring to FIG. 6, there is illustrated a front view of the cushion platform 10 having a top cushion 30 with a front cushion top surface 35, a front cushion rear surface 34 and a connection post 500.

Figure 7:
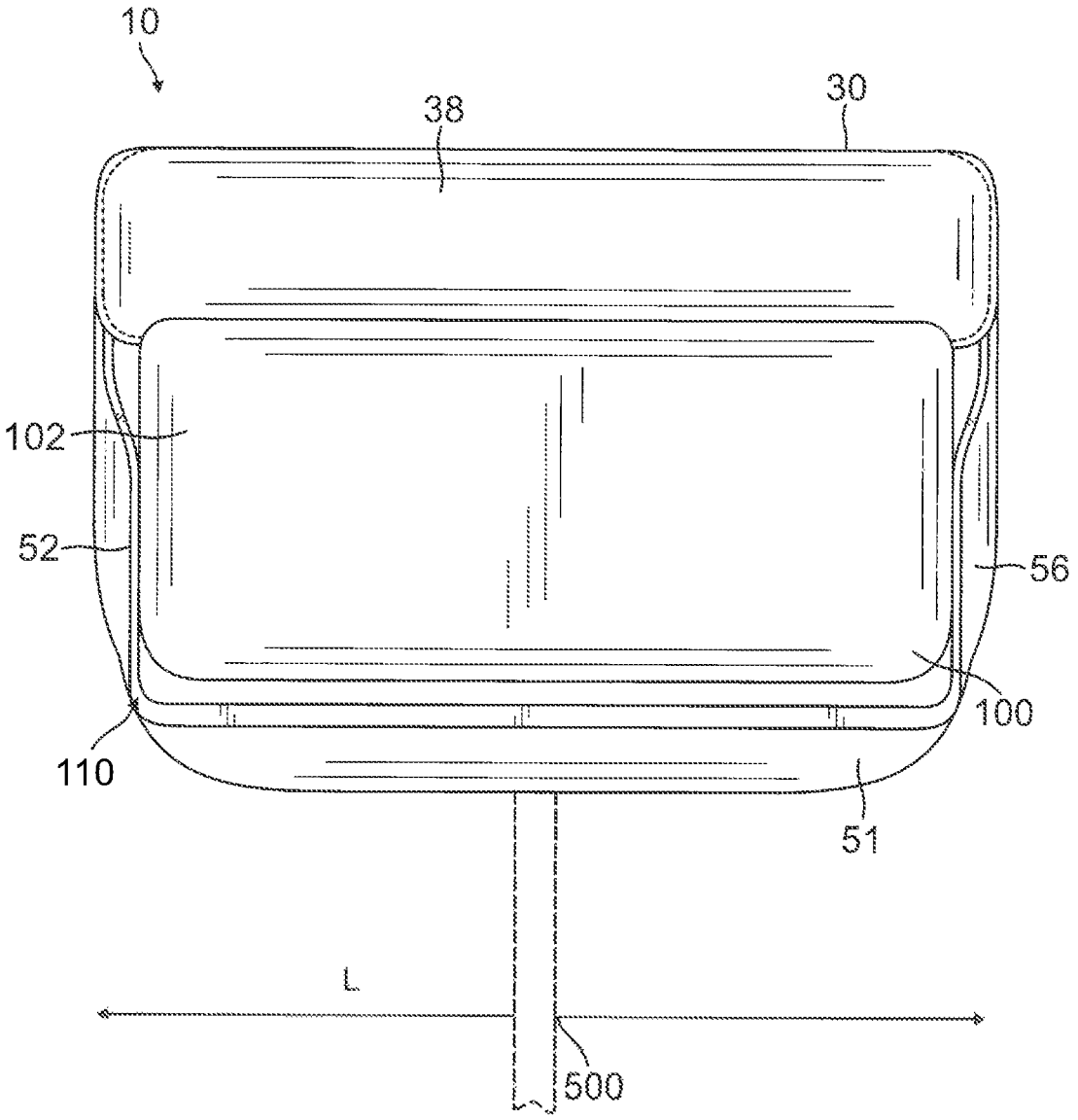
FIG. 7 is a front view of the cushion platform portion of the present invention back stretcher with the base removed.

Referring to FIG. 7, there is illustrated a front view of the cushion platform 10 retaining top cushion 30 and front cushion 100. Top cushion 30 has a top cushion front surface 38 that is directly above front cushion front surface 102 of front cushion 100. Left vertical wall 52, right vertical wall 56, and bottom wall 51 form the outer structure of cushion platform 10. Additionally referring to FIG. 7, there is illustrated front cushion 100 and front cushion support structure 110 not rotated or facing in the forward position. FIG. 7 also illustrates cushion platform 10 having a length L. The length L of cushion platform 10 can range from six (6) inches to four (4) feet and has a preferred length of sixteen (16) inches.

Figure 8:
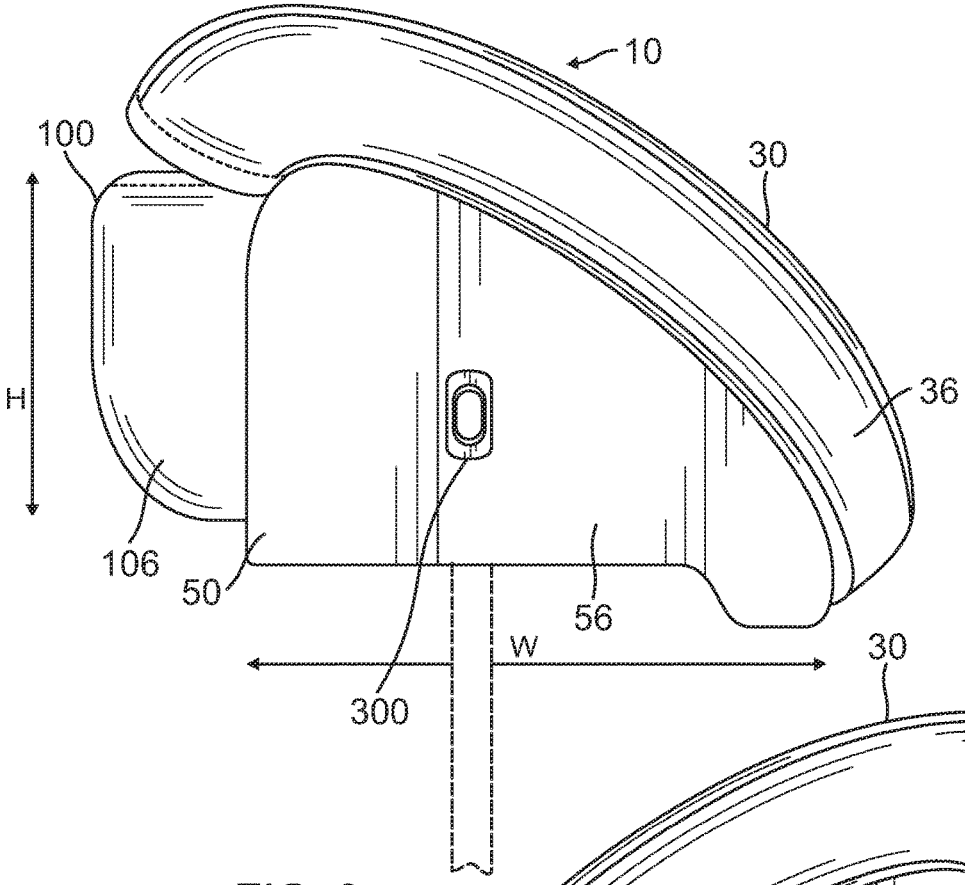
FIG. 8 is a right view of the cushion platform portion of the present invention back stretcher with the base removed.

Referring to FIG. 8, there is illustrated a right side view of the cushion platform 10 retaining top cushion 30 and front cushion 100. Right vertical wall 56 also has a power switch 300 for transitioning the present invention back stretcher from the off/non-oscillating position to the on/oscillating position. It is within the spirit and scope of the present invention for power switch 300 to be a variable speed rotational dial that allows the user to increase or decrease the oscillating speed of front cushion 100. Further referring to FIG. 8, there is illustrated top cushion 30 having a top cushion right surface 36 that is directly above cushion support structure 50 and a front cushion 100 having a front cushion right surface 106 that extends away from cushion support structure 50. Additionally referring to FIG. 8, there is illustrated cushion platform 10 having a width W and a height H. The height H of cushion platform 10 ranges from three (3) inches to three (3) feet and has a preferred height H of 7.5 inches. Similarly, width W of cushion platform 10 ranges from six (6) inches to four (4) feet and has a preferred width W of twelve (12) inches.

Figure 9:
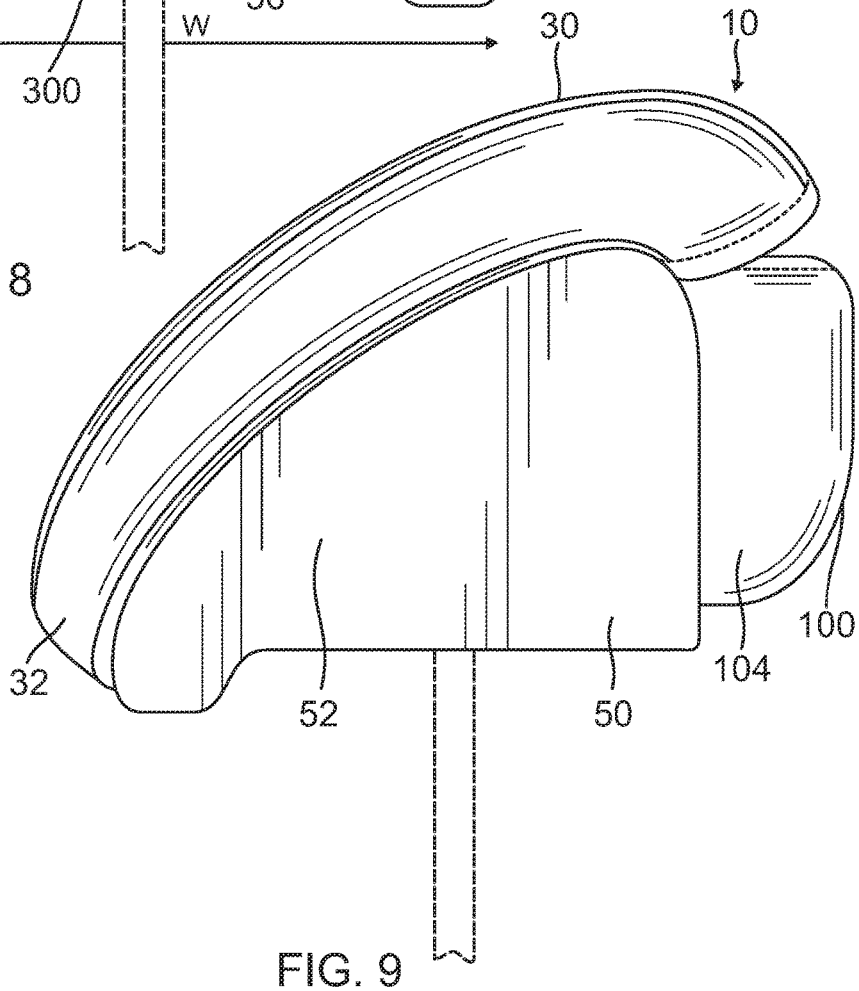
FIG. 9 is a left view of the cushion platform portion of the present invention back stretcher with the base removed.

Referring to FIG. 9, there is illustrated a left side view of the cushion platform 10 retaining top cushion 30 and front cushion 100. Left vertical wall 52 is a mirror image of right vertical wall 56 without power switch 300. Further referring to FIG. 9, there is illustrated top cushion 30 having a top cushion left side surface 32 that is directly above cushion support structure 50 and a front cushion 100 having a front cushion left surface 104 that extends away from cushion support structure 50.

Figure 10:
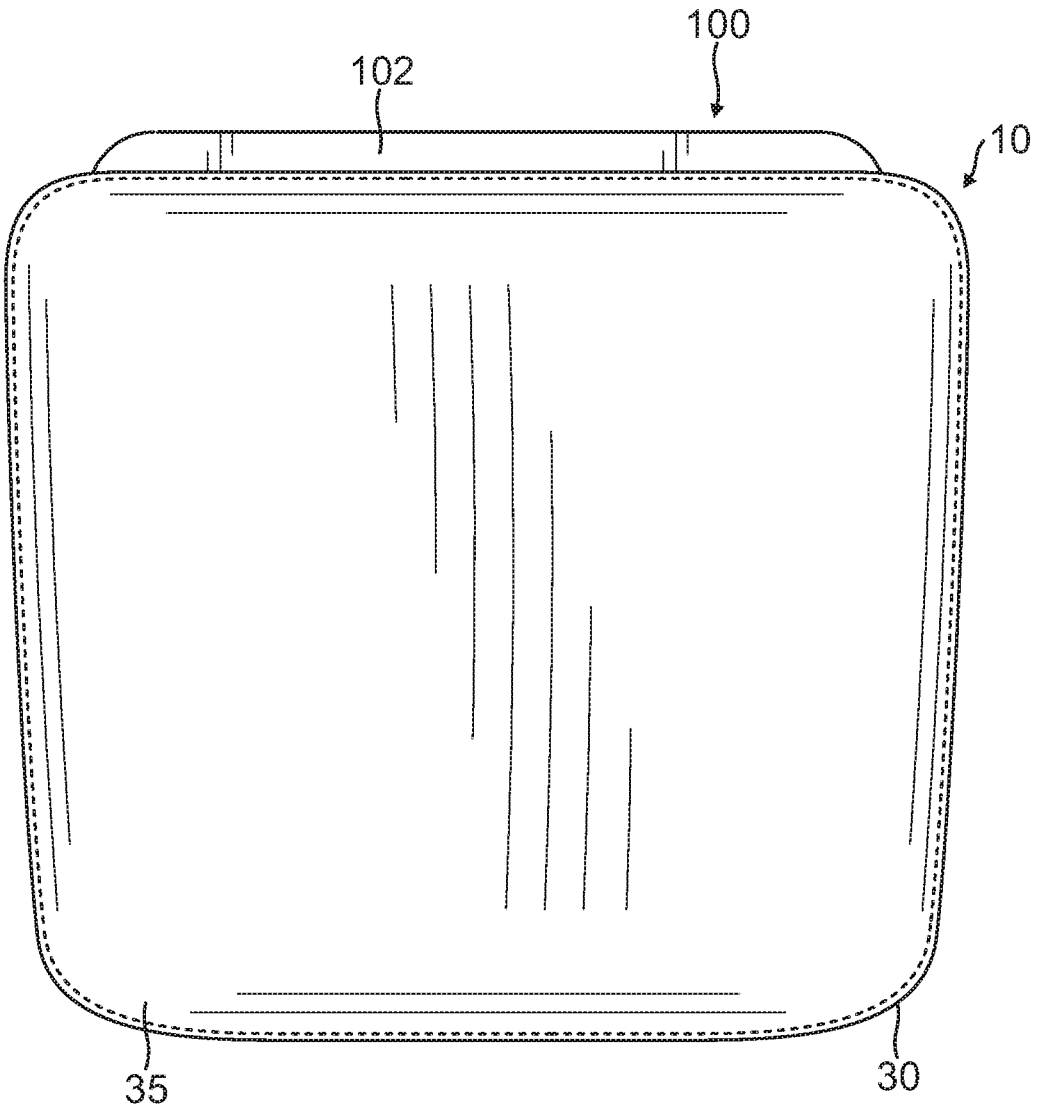
FIG. 10 is a top view of the cushion platform portion of the present invention back stretcher with the base removed.

Referring to FIG. 10, there is illustrated a top view of the cushion platform 10 having a top cushion 30 with a top cushion top surface 35 and front cushion 100 with a front cushion top surface 102.

Figure 11:
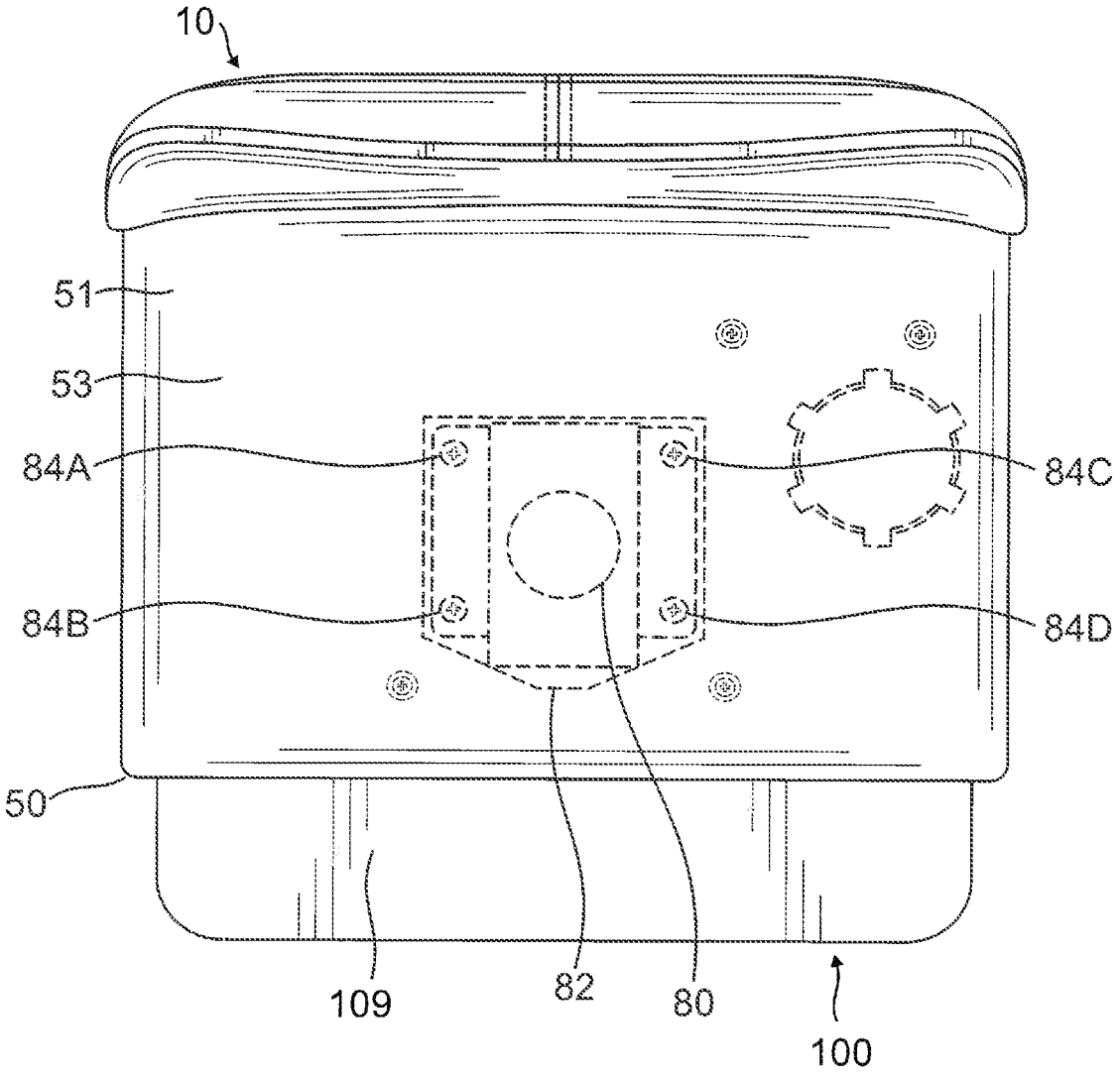
FIG. 11 is a bottom view of the cushion platform portion of the present invention back stretcher with the base removed.

Referring to FIG. 11, there is illustrated a bottom view of cushion platform 10 with top cushion support structure 50 having a bottom wall 51 with a centrally located connection plate 82. In the center of connection plate 82 is connection hole 80 that is sized to accept connection post 500. Connection plate 82 is affixed to the bottom of surface 53 of bottom wall 51 by connection screws 84A, 84B, 84C, and 84D. Also illustrated in FIG. 11 is front cushion 100 having a front cushion bottom surface 109.

Figure 12:
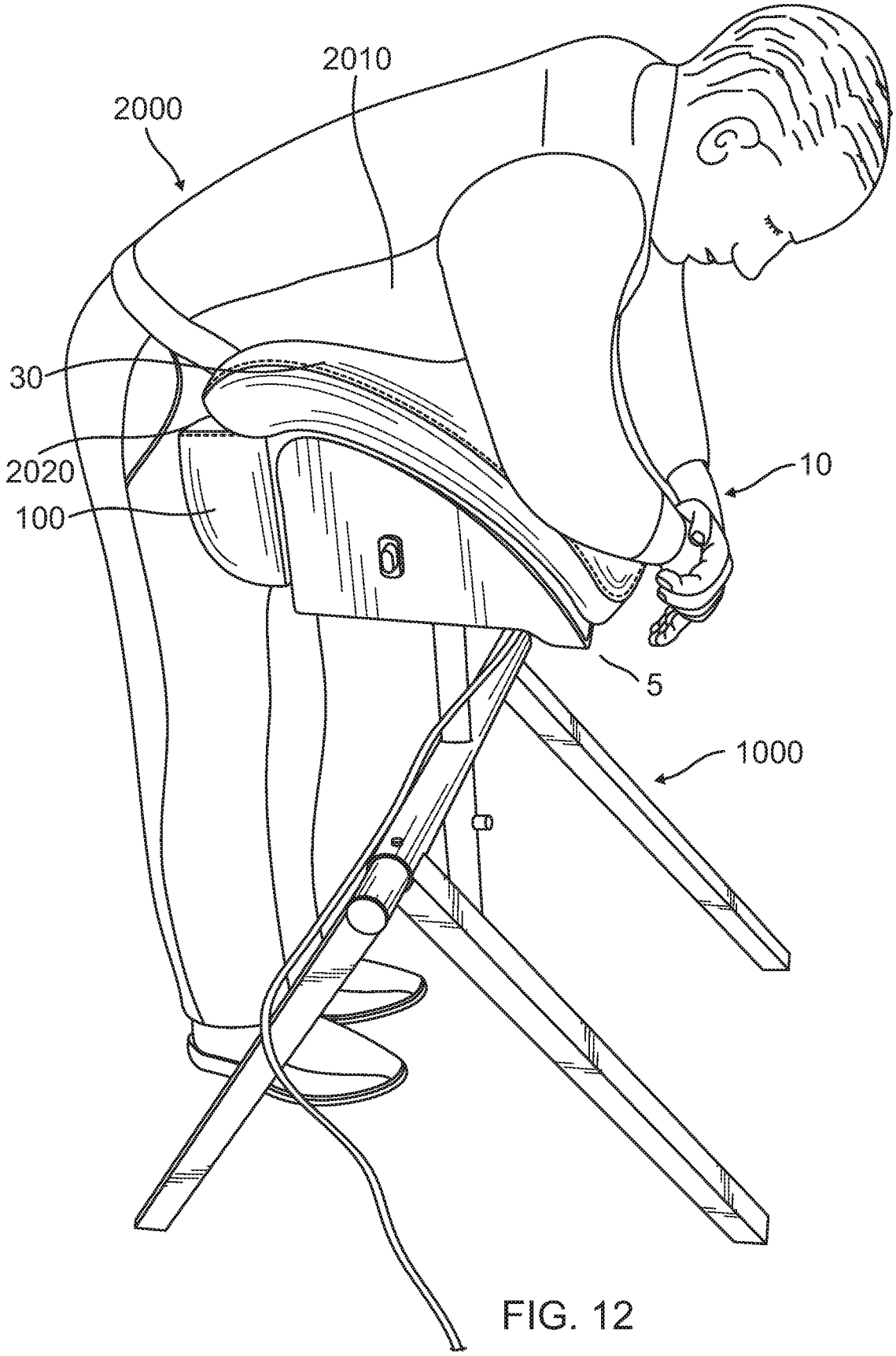
FIG. 12 is a right side perspective view of the present invention back stretcher with the base attached and a user resting the user's hips against the front cushion and resting their upper torso on the top cushion.

Referring to FIG. 12, there is illustrated a right side perspective view of the present invention back stretcher 5 with base 1000 attached and a user 2000 resting their upper torso 2010 on top cushion 30 of cushion platform 10 and the user's hips 2020 abutting and adjacent to front cushion 100. This is the preferred position of the present invention and provides a user with traction or stretching of the spine during operation and oscillating of front cushion 100. During operation the benefits received from the user by the oscillating front cushion 100 includes the reduction of back pain by the stretching of the spine. This is a vast improvement over the prior art by providing the user an easy method to stretch the back without the use of equipment such as an inversion table. Inversion tables are not only more difficult and risky to use, but can further require supervision during use as well. The present invention back stretcher provides the stretching as described above in a safer medium.

Figure 13:
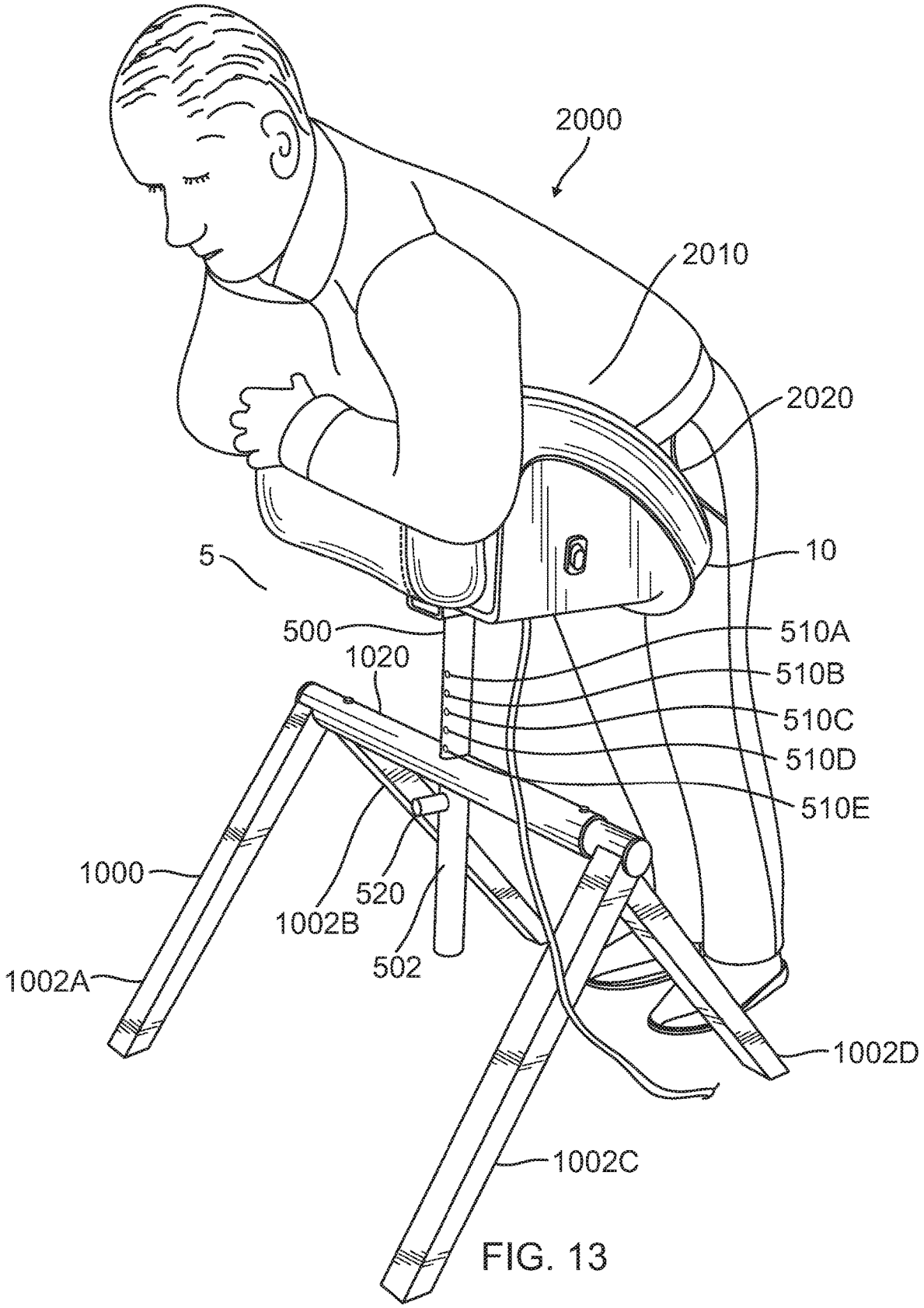
FIG. 13 is a left side perspective view of the present invention back stretcher with the base attached and a user resting the user's hips and upper torso against the top cushion.

Referring to FIG. 13, there is illustrated a left side perspective view of the present invention back stretcher 5 with the base 1000 attached and a user 2000 resting their hips 2020 and upper torso 2010 against top cushion 30. In this position the user may lean forward and stretch the back as desired. The shape and contour of top cushion 30 has been designed to accommodate a user 2000 bending and provide comfort during this stretching.

The present invention back stretcher 5 is also designed to accommodate users of different heights. Connection post 500 has a connection post circular exterior surface 502 that has connection post holes 510A, 510B, 510C, 510D, and 510E, that allow a user to raise or lower the cushion platform 10 to a desired height based on the height of the user. Once the desired height is reached, connection post pin 520 is inserted into a specific connection post hole (one of 510A to 510E) to prevent connection post 500 from traversing from a higher or lower elevation within base hole 1025 located at a central location of horizontal base bar 1020. Further referring to FIG. 13, there is illustrated base 1000 having support legs 1002A, 1002B, 1002C, and 1002D that provide stability and support for the present invention back stretcher 5 during use. The base 1000 of present invention back stretcher 5 is illustrated having four (4) support legs, however, it is within the spirit and scope of this invention for the base to have a number of support legs such as three that would provide stability and support to the cushion platform 10.

Figure 14:
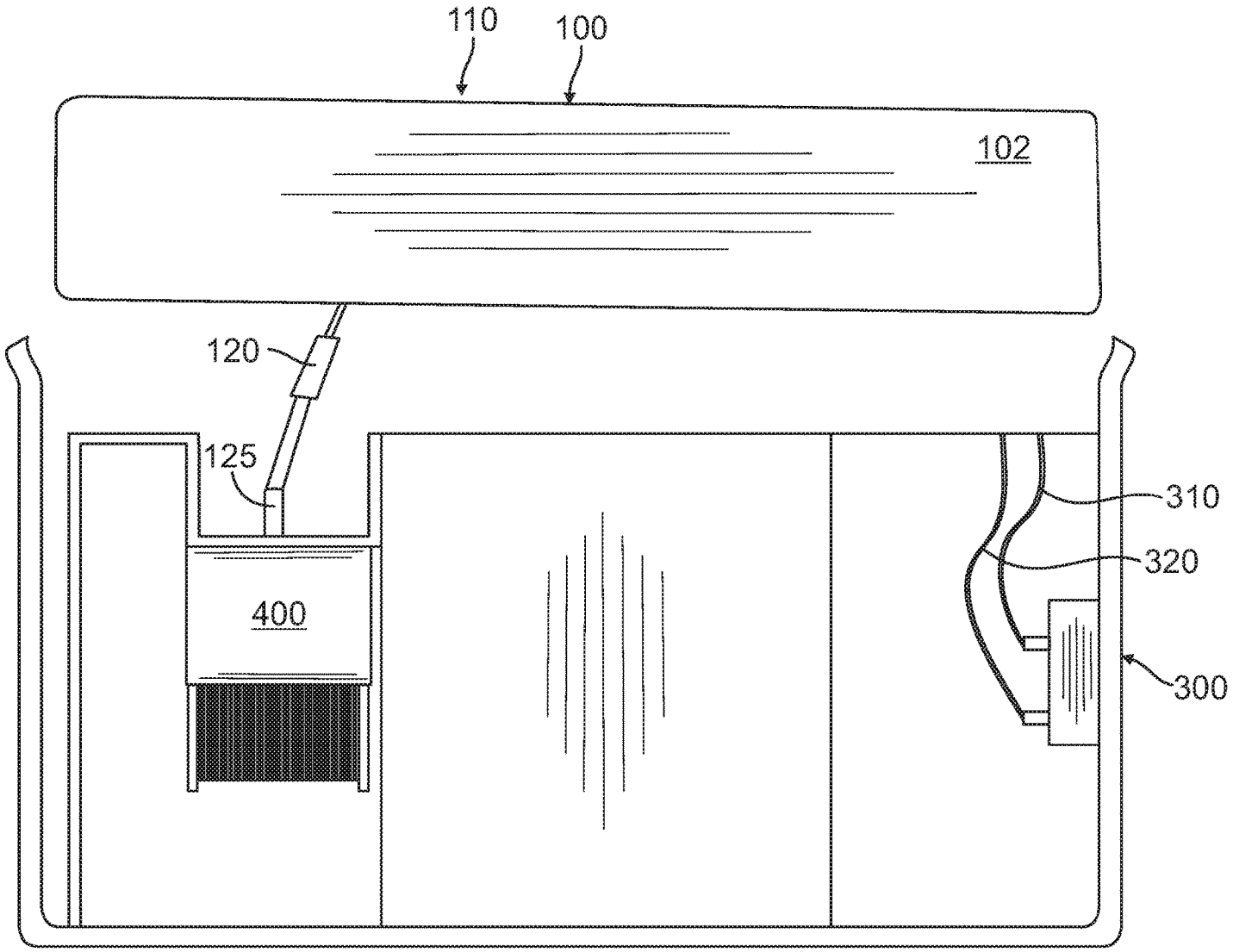
FIG. 14 is an internal schematic view of the present invention back stretcher illustrating the internal motor that powers the oscillating front cushion.

Referring to FIG. 14, there is illustrated an internal cross-sectional view of motor 400 that is connected to pivot arm 120. Pivot arm 120 is connected to front cushion support structure 110 that retains front cushion 100 having a front cushion front surface 102. Power switch 300 connects to a hot wire 310 and a ground wire 320 to provide alternating current (AC) power to motor 400. Pivot arm 120 connects to rotational plate 125. Rotational plate 125 is connected to motor 400 that causes rotational plate 125 to rotate. Motor 400 is a rotational motor used to provide an oscillating motion.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A back stretching apparatus comprising:

a. a cushion platform having a top cushion, a top cushion support structure, a front cushion, a front cushion support structure, a connection post, and a base;

b. said top cushion support structure having a left vertical wall, a back vertical wall, a right vertical wall, a left upper curved wall section, a back upper curved wall section, a right upper curved wall section, and a platform interior chamber;

c. said back upper curved wall section is directly connected to said left upper curved wall section and to said right upper curved wall section to form a top shelf;

d. said platform interior chamber contains a platform horizontal base plate and a platform vertical base plate that support and are removably affixed to said top cushion;

e. said front cushion support structure has a generally rectangular shaped front vertical plate and a centrally located horizontal plate with said front vertical plate sized to retain said front cushion;

f. said front cushion support structure is connected to a motor by a pivot arm located underneath said platform horizontal base plate;

g. said pivot arm causes said front cushion support structure to oscillate in a counterclockwise direction to a maximum angle $\theta_1$ and a counter clockwise direction to a maximum angle $\theta_2$ between said left vertical wall and said right vertical wall;

h. said top cushion support structure has a bottom wall with a centrally located connection plate and a connection hole with said connection hole sized to accept a connection post; and i. a base having support legs and a horizontal base bar with said horizontal base bar having a base hole that is sized to accept said connection post.

2. The back stretching apparatus in accordance with claim 1, further comprising: said base has four support legs.

3. The back stretching apparatus in accordance with claim 1, further comprising: said left vertical wall is a mirror image of said right vertical wall.

4. The back stretching apparatus in accordance with claim 1, further comprising: said cushion platform has a length between 12 inches and 24 inches.

5. The back stretching apparatus in accordance with claim 1, further comprising: said cushion platform has a width between 8 inches and 18 inches.

6. The back stretching apparatus in accordance with claim 1, further comprising: said cushion platform has a height between 6 inches and 12 inches.

7. The back stretching apparatus in accordance with claim 1, further comprising: said maximum angle $\theta_1$ is less than twenty degrees and said maximum angle $\theta_2$ is less than twenty degrees.

8. A back stretching apparatus comprising:

a. a cushion platform having a top cushion, a top cushion support structure, a front cushion, a front cushion support structure, a connection post, and a base;

b. said top cushion support structure having a left vertical wall, a back vertical wall, a right vertical wall, a left upper curved wall section, a back upper curved wall section, a right upper curved wall section, and a platform interior chamber;

c. said back upper curved wall section is directly connected to said left upper curved wall section and said right upper curved wall section to form a top shelf;

d. said platform interior chamber contains a platform horizontal base plate and a platform vertical base plate;

e. said front cushion support structure has a generally rectangular shaped front vertical plate and a centrally located horizontal plate with said front vertical plate sized to retain said front cushion;

f. said front cushion support structure is connected to a motor by a pivot arm located underneath said platform horizontal base plate;

g. said pivot arm causes said front cushion support structure to oscillate in a counterclockwise direction to a maximum angle $\theta_1$ and a counter clockwise direction to a maximum angle $\theta_2$ between said left vertical wall and said right vertical wall;

h. said top cushion support structure has a bottom wall with a connection plate and a connection hole with said connection hole sized to accept a connection post; and i. a base having support legs and a horizontal base bar with said horizontal base bar having a base hole that is sized to accept said connection post.

9. The back stretching apparatus in accordance with claim 8, further comprising: said base has four support legs.

10. The back stretching apparatus in accordance with claim 8, further comprising: said left vertical wall is a mirror image of said right vertical wall.

11. The back stretching apparatus in accordance with claim 8, further comprising: cushion platform has a length between 12 inches and 24 inches.

12. The back stretching apparatus in accordance with claim 8, further comprising: cushion platform has a width between 8 inches and 18 inches.

13. The back stretching apparatus in accordance with claim 8, further comprising: cushion platform has a height between 6 inches and 12 inches.

14. The back stretching apparatus in accordance with claim 8, further comprising: said maximum angle $\theta_1$ is less than twenty degrees and said maximum angle $\theta_2$ is less than twenty degrees.

15. A back stretching apparatus comprising:

a. a cushion platform having a top cushion, a top cushion support structure, a front cushion, a front cushion support structure, a connection post, and a base;

b. said top cushion support structure having a left vertical wall, a back vertical wall, a right vertical wall, a left upper curved wall section, a back upper curved wall section, a right upper curved wall section, and a platform interior chamber;

c. said back upper curved wall section is directly connected to said left upper curved wall section and said right upper curved wall section to form a top shelf;

d. said platform interior chamber contains a platform horizontal base plate and a platform vertical base plate;

e. said front cushion support structure has a front vertical plate sized to retain said front cushion;

f. said front cushion support structure is connected to a motor by a pivot arm;

g. said pivot arm causes said front cushion support structure to oscillate in a counterclockwise direction to a maximum angle $\theta_1$ and a counter clockwise direction to a maximum angle $\theta_2$ between said left vertical wall and said right vertical wall;

h. said top cushion support structure has a bottom wall with a connection plate and a connection hole with said connection hole sized to accept a connection post; and i. a base having support legs and a horizontal base bar with said horizontal base bar having a base hole that is sized to accept said connection post.

16. The back stretching apparatus in accordance with claim 15, further comprising: said base has four support legs.

17. The back stretching apparatus in accordance with claim 15, further comprising: said left vertical wall is a mirror image of said right vertical wall.

18. The back stretching apparatus in accordance with claim 15, further comprising: cushion platform has a length between 12 inches and 24 inches and a width between 8 inches and 18 inches.

19. The back stretching apparatus in accordance with claim 15, further comprising: cushion platform has a height between 6 inches and 12 inches.

20. The back stretching apparatus in accordance with claim 15, further comprising: said maximum angle $\theta_1$ is less than twenty degrees and said maximum angle $\theta_2$ is less than twenty degrees.

* * * * *